US005372364A

United States Patent [19]

Arroyo

[11] Patent Number: 5,372,364

[45] Date of Patent: Dec. 13, 1994

[54] SOCCER TABLE GAME WITH CUE STICK

[75] Inventor: Bernardo Arroyo, Lynwood, Calif.

[73] Assignee: Rosa M. Avalos, Lynwood, Calif.

[21] Appl. No.: 249,370

[22] Filed: May 27, 1994

[51] Int. Cl.[5] ..... A63F 7/06

[52] U.S. Cl. ..... 273/85 R; 273/118 R

[58] Field of Search ..... 273/85 R, 94, 118 R, 273/119 R, 122 R, 126 R

[56] References Cited

U.S. PATENT DOCUMENTS

| | | | |
|---|---|---|---|
| 1,265,761 | 5/1918 | Ehrenhardt et al. | 273/126 R |
| 1,819,932 | 8/1931 | Walden . | |
| 2,052,035 | 8/1936 | Potter | 273/94 |
| 2,824,739 | 2/1958 | Frank | 273/126 R |
| 3,834,707 | 9/1974 | Birkett | 273/126 A |
| 3,926,432 | 12/1975 | Furr et al. | 273/85 D |
| 4,060,245 | 11/1977 | Gamez Duch | 273/85 R |
| 4,063,728 | 12/1977 | Zemanek | 473/13 |
| 4,148,484 | 4/1979 | Georgiev et al. | 273/85 R |
| 4,257,599 | 3/1981 | Cutri | 273/85 R |
| 4,274,635 | 6/1981 | Pakogian | 273/85 R |
| 4,382,600 | 5/1983 | Vieira | 273/118 R |
| 4,408,761 | 10/1983 | McAllister | 273/85 R |
| 5,092,595 | 3/1992 | Daravina | 273/85 R |

*Primary Examiner*—William H. Grieb

*Attorney, Agent, or Firm*—Fulwider, Patton, Lee & Utecht

[57] ABSTRACT

A soccer game apparatus to be played by two or more players which includes a planar rectangular base area to serve as a playing surface, a peripheral wall surrounding the planar playing surface, a spherical soccer ball of predetermined size, a pair of goal slots, catch basins, and goal nets, a plurality of pegs disposed in a predetermined pattern on the playing surface to form ball paths for unimpeded travel of the soccer ball, and cue sticks used by the players to move the soccer ball on the playing surface.

8 Claims, 1 Drawing Sheet

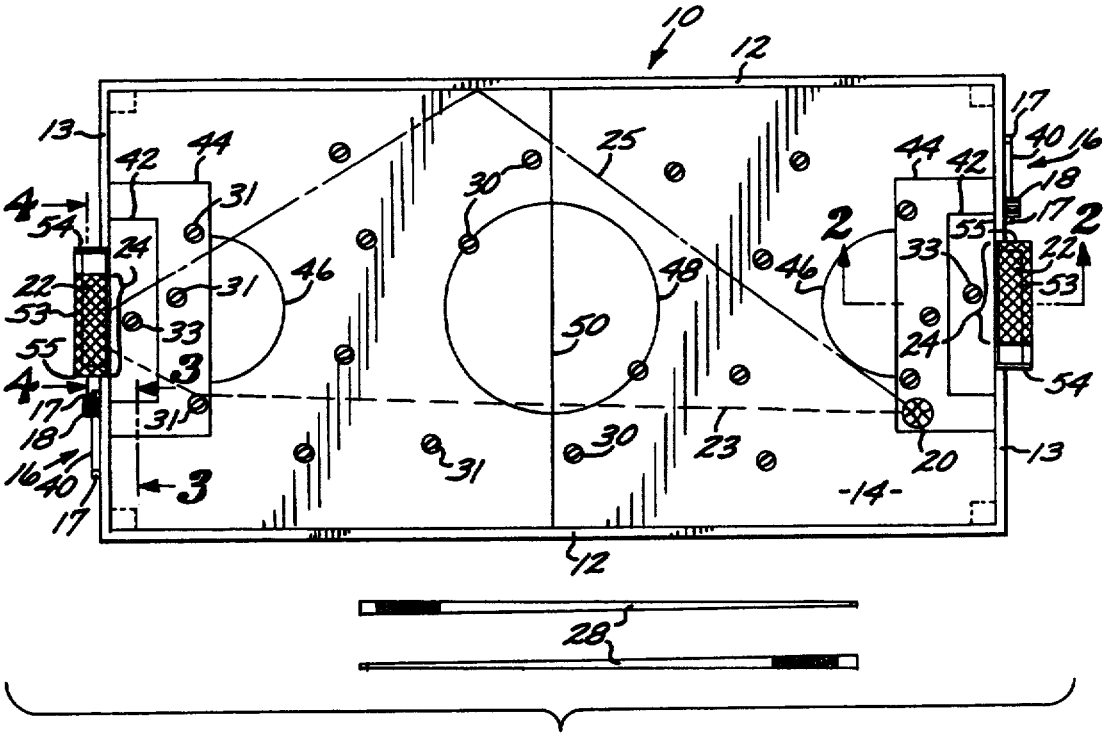
FIG. 1
FIG. 2
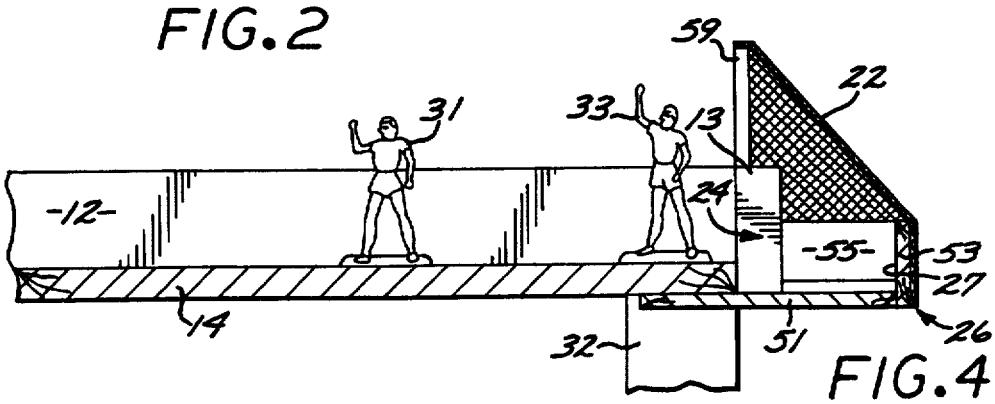
FIG. 4
FIG. 3
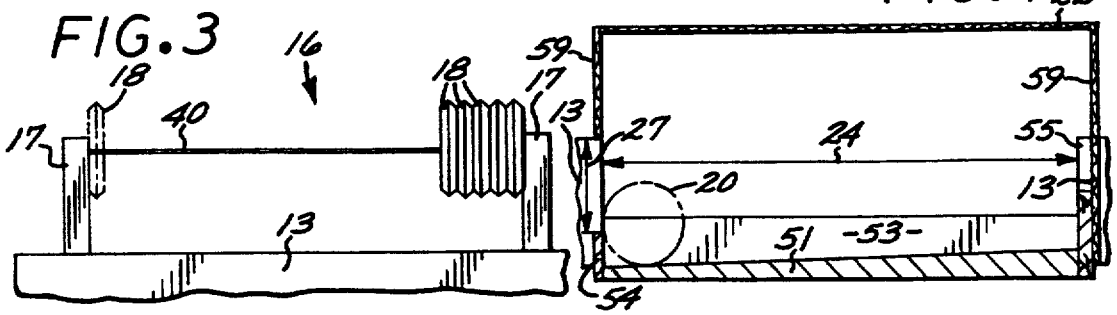

SOCCER TABLE GAME WITH CUE STICK

BACKGROUND OF THE INVENTION

1. Field of the Invention

The invention is generally related to a table game apparatus and, more particularly, to a soccer game apparatus played on a table top surface.

2. Description of the Prior Art

Soccer is the most popular sport in the world. Popularity of the sport has grown to such an extent that it is rapidly overtaking other major sports, even in the United States, in popularity. The success of the sport has been so great that the prestigious World Cup competition has been scheduled in the United States for 1994. However, to actually play the official sport of soccer, a large field, bulky and expensive equipment, and twenty two players are required. There is therefore a need for a game that faithfully simulates the sport of soccer but that can be played in a more confined area, with less and without the physical exertion or high degree of athletic skill normally associated with the sport. The present invention meets this need.

In the field of table top soccer game apparatus, various different embodiments of such soccer games have been known for a number of years, and by way of example, forms of such embodiments can be found in U.S. Pat. Nos. 5,092,595, 4,274,635, and 4,257,599.

The above mentioned prior art table top soccer games have some disadvantageous features associated with them. For example, there is the potential for discrepancies as to whether a goal is scored or not in the prior art embodiments. The rules require that the ball must be determined to have completely crossed over the goal line in order to be deemed a goal, which is a rule that inevitably invites debates among rival participants. There is also the possibility that a ball could completely cross the goal line and then be reflected back across the goal line by the back of the net, thereby adding confusion to the question of whether a goal has been scored or not. Another disadvantage of the prior art embodiments deals with the retrieval of the ball after a goal has been scored. If the ball remains in the goal net after a score, it will be necessary for a player to reach into the goal net from the front side with his or her hand to retrieve the ball. Such nets are often relatively small and somewhat delicate, thus presenting some risk to damage from repeated or forceful contact by a player removing the ball directly from the net, thereby reducing the useful life of the invention.

As such, it may be appreciated that there continues to be a need for a new and improved soccer game apparatus which provides a simulated soccer game that is both easy to use and that requires players to develop strategies to be successful at playing the game, while at the same time avoiding unwanted confusion as to whether a player has scored a goal or not. The instant invention addresses such needs.

SUMMARY OF THE INVENTION

Briefly and in general terms, the present invention provides a new and useful soccer game apparatus. The invention is directed to a table top soccer game which is played by two or more people. In accordance with the invention, the soccer game apparatus includes a planar playing surface marked with respective goal and penalty boxes, a number of miniature figures placed on the playing surface in a predetermined pattern to define respective soccer ball paths from the respective one end of the field to the other, a soccer ball of predetermined size to be driven along such paths, a pair of goal assemblies, and a pair of cue sticks to be used to move the soccer ball along the playing surface. The soccer game apparatus of the present invention is portable, relatively inexpensive to manufacture, and is suitable for use and enjoyment by adults and children alike.

In use, a player places the soccer ball within the penalty kick area defined by indicia disposed in front of his own goal assembly. He then strikes the ball with the provided cue stick to drive it toward the opposing goal through one of a plurality of predetermined pattern of ball paths formed between the figures mounted on the playing surface. If the ball successfully negotiates one of the ball paths between the players and passes through the goal assembly, then a goal is scored. The goal assembly includes a goal slot formed in the respective end walls, a goal net immediately above the goal slot, and a catch basin immediately behind the goal slot and recessed below the playing surface. When a goal is scored by an offensive player, the opposing player then retrieves the soccer ball from the catch basin and places it in the penalty zone in front of his net and strikes the ball toward the opposite goal. If one player's attempt to score is unsuccessful, the opposing player takes his or her turn from the place where the ball came to rest short of the goal. This continues until a predetermined number of goals is scored by one of the players. The players then rotate ends of the table and continue playing until one player reaches twice the predetermined number above. That player is then declared the winner.

Other features and advantages of the invention will become apparent from the following detailed description, taken in conjunction with the accompanying drawings, which illustrate, by way of example, the features of the invention.

DESCRIPTION OF THE DRAWINGS

FIG. 1 is a top plan view of a soccer game apparatus in accordance with the principles of the present invention;

FIG. 2 is a vertical sectional view, in enlarged scale, taken along the line 2—2 of FIG. 1;

FIG. 3 is a vertical sectional view, in enlarged scale, taken along the, line 3—3 of FIG. 1; and FIG. 4 is a vertical sectional view, in enlarged scale, taken along the line 4—4 of FIG. 1.

DETAILED DESCRIPTION OF THE PREFERRED EMBODIMENT

In the following description, like reference numerals will be used to refer to like or corresponding elements in the different figures of the drawings. Referring now to the drawings, and particularly to FIG. 1, there is shown the soccer game apparatus of the present invention which includes a rectangular elevated table top defining an upwardly facing horizontal planar playing surface 14 having oppositely disposed peripheral side walls 12 and end walls 13. Formed centrally in the opposed end walls are respective goal gates 24, which open into an extended catch basin 26 having the back side thereof covered by a flexible netting defining a goal net 22. Vertically extending rubber figurines simulating soccer players 30, 31 and 33 are fixedly mounted in spaced relation about the playing surface to define obstacles arranged to cooperate in forming therebetween respective ball paths for passage therealong of a rubber soccer ball 20. Cue sticks 28 are provided so that an offensive player might position the soccer ball in front of his own goal and strike such soccer ball with the working end of the cue stick to drive the ball toward the opposing goal in an effort to negotiate along a predetermined path to pass through the gate of the opposing goal and be received in an opposing catch basin 26. In the event the player fails to score a goal, the opposing player may then grasp his or her cue stick 28 and strike the ball from its position of rest in an effort to negotiate the path defined between the respective soccer FIGS. 30, 31 and 33 to be received in the opposing party's goal.

The top surface of the playing table may be formed of a plastic or wood sheet material with offensive and defensive players 30, 31 and 33, respectively, fixedly mounted thereon in spaced relation to form therebetween a plurality of ball travel paths, such as paths 23 and 25, from one goal to the other (FIG. 1). The playing surface is painted a typical green color and includes at the opposite ends respective rectangularly shaped goal boxes 42 centered in front of each of the respective goals and larger rectangular lines defining respective penalty boxes 44 with the classic semi-circularly shaped penalty arcs 46 formed in front thereof. Positioned in the center of the playing surface is the face off circle 48.

The peripheral walls 12 and 13 may be also formed of plastic or wood or other desirable material and are intended to define the marginal edges of the playing surface and to serve in retaining the soccer ball 20 within the playing surface (FIG. 1 ).

The players 30, 31 and 33 may be of any desired configuration and may be in the form of upstanding pegs or figurines as depicted (FIG. 2). The players are positioned throughout the playing surface to block the path of all but the most accurately struck ball from rolling directly from the penalty box 44 of one goal to the slot or gate 24 of the opposing zone (FIG. 1).

The respective catch basins are formed by respective downwardly recessed bottom walls 51 which angle downwardly to one side toward respective retrieval openings 27 and project beyond the marginal ends of the table top and are formed at their distal ends with respective upstanding back walls 53 and at their opposed sides with side walls 54 and 55 (FIGS. 1, 2 and 4). Flanking the opposite sides of the respective goal gates are laterally spaced apart vertical goal posts 59 which have mounted thereto the front marginal edges of the respective netting defining the goal net 22 (FIG. 2). The goal net then angles downwardly and rearwardly to be secured at its lower extremity to the respective back wall 53.

The bottom walls 51 of the respective catch basins slope laterally and downwardly toward one side thereof so that the ball received therein will roll to such one side (FIG. 4) to be retrieved by a player from a respective retrieval opening 27.

In the preferred embodiment, the table may have an overall dimension of 34" by 22" with the center lines 50 dividing the field into respective halves of 17" by 22" each. The respective goal gates are 4 ¾" wide and the respective goal boxes 42 are 10" wide. The penalty boxes 44 are 15" wide and 3" long. The diameter of the penalty arc 46 is about 7" and the center face off zone 48 is of a similar diameter. The players 30, 31 and 33 have effective diameters of about ½ and the soccer ball 20 has a diameter of about 5/8".

In operation, the soccer game table 10 of the present invention may be conveniently stored during non-use and is of a size and arrangement which can be easily and quickly moved into the game or entertainment area of a household when entertainment is desired. The game can be played with two, four or even more players. Typically, the players might undertake a skill effort such as striking the ball 20 with a cue stick 28 from a location, for example, one corner of the penalty box 44, in an effort to place the ball closest to the opposing goal or a preselected mark or player. The player who comes the closest may then be designated the offensive player to start the game. Assuming the game is to be played by two players (singles), the initial player will take the offensive position. The offensive play will be undertaken by placing the ball 20 in one forward corner of the offensive player's penalty box 44. The offensive player will then strike the ball with the tip of his cue stick 28 to drive such ball toward the opposing player's goal. Depending on the skill of the player, he or she may choose to aim the soccer ball 20 along any one a number of paths, such as paths 23 or 25. Assuming the player elects to drive the ball 20 from the lower forward corner of the right hand penalty box 44 shown in FIG. 1, the player can drive the ball along the path 23 to strike the defender 31 in the lower corner of the defensive defender's penalty box in an effort to ricochet the ball through the goal gate 24. Assuming the offensive player is successful, the ball will then pass through the defender's gate and strike against the back of the netting 22 and be directed forwardly into the catch basin 26 to roll along the floor thereof toward the retrieval slot 27 (FIG. 4). Should the offensive player be unsuccessful in his or her effort to score a goal, the ball may be deflected from a player, such as the player 31, back into the central area of the playing area to come to rest within the playing area. The opposing player will then take his or her turn by striking the ball at that location with his or her cue stick 28 to drive that ball toward the opposing player's goal in an effort to drive it through the goal gate and into that opposing player's goal net to be retained in the respective catch basin.

Should that player then succeed in scoring, the original player will then have an opportunity to again initiate play from one corner or the other of his or her penalty box 44. If desired, at this point the player at the right hand end of the table 10, as viewed in FIG. 1, may elect to strike the ball to drive it along the path 25 to strike the side rail 12 at the upper side of the figure to cause it to be rebounded in accordance with the angle of incidence toward the opposing goal in an effort to clear the defensive player 31 and goalie 33 to be received through the goal gate 24 and in the goal net 22.

It will be appreciated that the players may then continue to rotate turns and, when some one player reaches a predetermined cumulative total, such as five goals, the players may then rotate ends of the table to continue play. The score of the individual participants will be tallied by shifting the tally markers 18 back and forth on the respective slide wire 40 (FIG. 3).

From the foregoing, it will be appreciated that the soccer game apparatus of the present invention provides a convenient and challenging game which will provide soccer enthusiasts with home entertainment having a faithful simulation of traditional soccer play to thus provide long hours of high level entertainment. The apparatus provides for accurate indication of a player's success in endeavoring to score a goal and allows for a multitude of different strategies and techniques in an effort to demonstrate skill in scoring soccer goals.

What is claimed is:

1. A soccer game apparatus comprising:

a table top having an upwardly facing planar playing surface;

a peripheral wall surrounding said playing surface and including respective opposite end walls formed with respective goal slots;

a soccer ball of predetermined size for rolling on said surface;

a pair of catch basins, one disposed under each of said goal slots, for receipt of said ball;

a pair of nets, one disposed above each of said slots for being struck by said ball when propelled from said playing surface through the respective said goal slots;

indicia on said playing surface in front of the respective said slots defining respective ball launch areas;

a plurality of pegs simulating soccer players disposed in a pattern on said playing surface and cooperating to form therebetween a plurality of predetermined ball paths from the respective said ball launch areas at the respective ends of said surface toward the respective slots at the respective opposite ends for passage therealong of said ball; and at least one cue stick for striking said ball to drive it along the respective said paths from the respective said launch areas to the respective said goal slots.

2. The soccer game apparatus of claim 1 that includes:

a pair of score keeping means disposed at opposite extremities of said playing surface.

3. The soccer game apparatus of claim 2 wherein:

said playing surface is rectangular in shape; and said score keeping means are oppositely disposed adjacent said nets and include a pair of vertical bars, a cylindrical horizontal slide wire attached to said vertical bars, and a plurality of tally markers slidably mounted on said horizontal slide wire.

4. The soccer game apparatus of claim 1 wherein:

said pegs are in the form of miniature soccer figures and total twenty two in number.

5. The soccer game apparatus of claim 3 wherein:

said rectangular playing surface has the approximate dimensions of substantially twenty two inches in width and thirty four inches in length;

said soccer ball is substantially five eighths of an inch in diameter;

said ball paths have predetermined widths on the order of three to five inches;

said perimeter wall extends approximately two inches above said playing surface; and said goal slots are substantially four and three quarter inches in length.

6. The soccer game apparatus of claim 3 wherein:

said rectangular playing surface defines the upper extremity of a table, said table including a plurality of legs to support said rectangular playing surface at a predetermined elevation above the ground.

7. The soccer game apparatus of claim 1 wherein:

said catch basins are downwardly recessed pockets disposed behind said goal slots and include a planar bottom sheet extending beneath and attaching to the underside of said playing surface, and include a vertical back wall, two vertical lateral walls and a vertical retrieval slot opening formed in one of said lateral walls; and said planar bottom sheet defines the bottom extremity of said catch basins and is intentionally slanted at a predetermined angle with its lower lateral extremity corresponding to said lateral wall with said retrieval slot opening for easy retrieval of said soccer ball when said soccer ball enters said catch basin.

8. A soccer game apparatus comprising:

a table top having an upwardly facing rectangular planar playing surface;

a peripheral wall surrounding said playing surface to define the boundaries thereof and formed in the respective opposite end walls with respective goal slots;

a soccer ball of predetermined size for rolling on said surface to rebound from said wall and roll through the respective said goal slots;

a pair of catch basins, one disposed behind each of said goal slots, for receipt of said ball to indicate a score;

a pair of nets, one disposed behind each of said slots for being struck by said ball when propelled from said playing surface through the respective said goal slots;

indicia on said playing surface in front of the respective said slots defining respective ball launch areas;

a plurality of pegs simulating soccer players disposed in a pattern on said playing surface and cooperating to form therebetween a plurality of predetermined ball paths from the respective said ball launch areas at the respective ends of said surface toward the respective slots at the respective opposite ends for passage therealong of said ball; and at least one cue stick for striking said ball to drive it along the, respective said paths from the respective said launch areas along selected ones of said predetermined paths to the respective said goal slots.

* * * * *